United States Patent [19]

Maly

[11] Patent Number: 4,976,827

[45] Date of Patent: Dec. 11, 1990

[54] PROCESS FOR PRETREATING STRIPS AND FOILS OF ALUMINUM OR ALUMINUM ALLOYS

[75] Inventor: Zdenek Maly, Kreuzlingen, Switzerland

[73] Assignee: Swiss Aluminium Ltd., Chippis, Switzerland

[21] Appl. No.: 837,807

[22] Filed: Mar. 10, 1986

Related U.S. Application Data

[63] Continuation-in-part of Ser. No. 792,275, Oct. 28, 1985, abandoned, which is a continuation of Ser. No. 711,598, Mar. 13, 1985, abandoned.

[51] Int. Cl.[5] ..... C25D 9/06

[52] U.S. Cl. ..... 204/15; 204/28; 204/58

[58] Field of Search ..... 204/28, 15, 58

[56] References Cited

U.S. PATENT DOCUMENTS

| | | | |
|---|---|---|---|
| 3,243,362 | 3/1966 | Manhart | 204/58 |
| 3,755,116 | 8/1973 | Terai et al. | 204/28 X |
| 3,824,159 | 7/1974 | Wehrmann | 204/58 |
| 3,915,811 | 10/1975 | Tremmel et al. | 204/33 |
| 4,014,758 | 3/1977 | Kawai et al. | 204/28 |

FOREIGN PATENT DOCUMENTS

| | | | |
|---|---|---|---|
| 41803 | 12/1971 | Japan | 204/58 |
| 8787 | 4/1975 | Japan | 204/58 |
| 411164 | 5/1974 | U.S.S.R. | 204/58 |
| 451801 | 3/1975 | U.S.S.R. | 204/58 |

*Primary Examiner*—G. L. Kaplan

*Attorney, Agent, or Firm*—Bachman & LaPointe

[57] ABSTRACT

Prior to coating with lacquer or adhesive, or laminating with plastic, strips or foils of aluminum or aluminum alloys are pretreated in an electrolyte by electrochemical oxidation using alternating current. These strips or foils are passed through an aqueous electrolyte which is heated to 25°-95° C. and has a pH adjusted to 4.2-12.5. The electrolyte is silicate-free and contains 0.01-10 weight percent of an organic compound which forms a complex with aluminum. A current of 10-500 coulomb/dm$^2$ is supplied to the workface of the strips or foils.

15 Claims, 2 Drawing Sheets

PROCESS FOR PRETREATING STRIPS AND FOILS OF ALUMINUM OR ALUMINUM ALLOYS

CROSS-REFERENCE TO RELATED APPLICATIONS

This is a Continuation-In-Part of U.S. patent application Ser. No. 792,275, Filed Oct. 28, 1985, which in turn is a Continuation of U.S. patent application Ser. No. 711,598, Filed Mar. 13, 1985 and both now abandoned.

BACKGROUND OF THE INVENTION

The invention relates to a process for pretreating strips and foils of aluminum or aluminum alloys before lacquering, adhesive coating or laminating with plastic, and this by electrochemical oxidation in an electrolyte using alternating current.

Lacquered or laminated aluminum strips and foils are used especially for making foodstuff packaging, the aluminum being protected from corrosion by a coating of lacquer. For many forms of packaging it is sufficient for the lacquer or adhesive to be deposited on untreated aluminum. For demanding applications on the other hand e.g. the production of deep-drawn containers for pasteurizable or sterilizable contents, pretreatment of the strip or foils is necessary to achieve adequate adhesion.

A normal form of pretreatment is continuous degreasing followed by chemical conversion of the surface forming a so-called conversion coating. Most of these processes are based on a reaction of chromic acid, fluoric acid and phosphoric acid with aluminum, as a result of which the conversion coatings contain $Cr^{VI}$ compounds which are increasingly undesirable or even suspect in use with foodstuff packaging. Solutions permitting the formation of $Cr^{VI}$-free conversion coatings are already known; the quality of these coatings with respect to adhesion and corrosion resistance is however still inadequate, especially for sterilizable forms of packaging.

It is known from German Patent No. 17 71 057 that continuous pretreatment of a strip of aluminum prior to lacquer coating is possible by passing the strip through an aqueous, sulfuric acid bath containing electrodes at a temperature between 50° C. and the boiling point of the bath, and oxidizing the said strip electrochemically using alternating current. In that process an oxide layer is formed on the aluminum strip when, due to the alternating current, the aluminum is made the anode, and that layer is for the greater part redissolved again when the aluminum is made the cathode. As such the dissolution does not take place uniformly, but locally so that craters are formed in the very thin (approx. 0.05 m) oxide layer. The widespread pitting of the oxide layer is one reason for the good bonding of coating materials to the aluminum strip, especially lacquer coatings.

A further improvement in lacquer adhesion is achieved using the process described in German patent publication No. DE-OS 33 25 802 in which the oxidation of an aluminum strip is performed with 3 phase alternating current, one phase of which is transformed to dc, in such a manner that the strip passes three electrodes in succession. Of these electrodes at least one, preferably the middle one, is connected to the dc phase, the other two to the three phase supply.

The disadvantage of the known oxidation processes using acidic media is the relatively high concentration of sulfuric acid viz., 15–20%, and the operating temperature of at least 80° C. which must be maintained otherwise a significant loss in adhesion results.

If the oxidation is performed in alkaline electrolytes e.g. containing hydroxides, carbonates and phosphates at concentrations below 1 weight percent and at temperatures below 50° C., oxide layers providing good adhesion can be obtained. These alkaline processes, however, demand exact regulation of the pH value, temperature and concentration of constituents, which is very difficult with increasing concentration of aluminum in solution. Even small deviations from the correct value can suddenly lead from good to poor adhesion properties.

In addition, the use of silicate-containing electrolyte systems is disadvantageous because a silicate deposit is built up on the aluminum surface with the effect that the following procedure of electrochemical oxidation is imperfect in that the oxidized surface is disturbed. This causes a bad adherence of the lacquer during application and/or afterwards because the bad oxidized metal surface parts have the tendency to corrode within a short time. This is particularly undesirable where one thin layer coating of lacquer is applied, as for example, for foodstuff packaging in the range of 10 grams lacquer per square meter aluminum strip or foil.

The object of the present invention is to develop a process for pretreating aluminum strips or foils, prior to lacquering, coating with adhesive or laminating with plastic, using electrochemical oxidation and an electrolytic bath which operates at lower concentrations and temperatures than the baths used up to now, provides the same or better adhesion and is less aggressive. Furthermore the process should employ non-toxic constituents which will be non-hazardous to the environment i.e. no undesirable fumes resulting from decomposition and no contamination of waste water systems, and will leave no substances in the conversion coating which are damaging to the health.

SUMMARY OF THE INVENTION

This object is achieved by way of the invention in which the strips or foils are passed through a silicate-free aqueous electrolyte heated to 25–95° C., having a pH of 4.2–12.5 and containing 0.01-10 wt-% of an organic compound that forms a complex with aluminum and contains at least one amino group with at least one carboxyl group attached to its nitrogen atom, and in which process a current of 10–500 coulomb/dm$^2$ is supplied to the work face of the strip or foil.

The carboxyl group/groups attached to the nitrogen atom of the amino group/groups are preferably those of formic acid, acetic acid or propionic acid.

Salts of nitrilo-tri-acetic acid (NTA) or ethylene diamino triacetic acid (EDTA) have proved particularly advantageous as complexing compounds, the cations preferably being alkali metal ions or ammonium ions. One example is nitrilo-tri-acetic acid-tri sodium salt (NTA-3Na).

In the industrial application of the process according to the invention it has been found that the complexing organic compounds should preferably be present at a concentration of 0.1–5 wt-%, in particular 0.5–2 wt-%. It was found that even using electrolytes containing only 0.01 wt-% of the complexing organic compound it is possible to produce oxide layers providing lacquer adhesion values (peel strength) of over 30 N/15 mm, if the necessary conductivity and pH value are adjusted using NaOH. In this connection, comparative trials showed that with a NaOH concentration of 0.1 wt-% adhesion strength values of 18–22 N/15 mm can be reached. On adding 0.01 wt-% NTA this rises immediately to more than 30 N/15 mm. This confirms the participation of the complexing organic compounds in the oxidation reactions in which chelates i.e. known excellent adhesion promoters, may be formed. Moreover, since the electrolyte is silicate-free, undesirable silicate deposits are not built up on the aluminum surface.

Also, if substances of only partly neutralized acid groups (up to pH 7 in a 1% solution) are employed, very good, usable oxide layers are obtained at 80° C. It is however advantageous to oxidize with fully neutralized substances, in particular at a pH value of 9.5–12. Good oxide layers can also be produced in the lower claimed temperature range using such electrolytes. However, the bath is preferably held at a temperature between 60° and 70° C.

The aluminum dissolved during the oxidation reaction saturates the complexing agent, which then reduces the oxidizing power of the electrolyte. Increasing the concentration of the complexing agent to up to 10 wt-% delays this saturation. It also causes the pH value and conductivity of the electrolyte to fall. However, by addition of alkali substances, preferably continuously and in particular in the form of sodium hydroxide, potassium hydroxide, sodium carbonate or potassium carbonate, the initial pH value, conductivity and thus the oxidizing power of the electrolyte, can be kept constant. When the concentration of aluminum in the electrolyte reaches a specific limit, it begins to precipitate out as aluminum hydroxide which can be filtered off. This way the composition of the bath is largely stabilized so that only the amount of electrolyte dragged out by the strip has to be replaced and possibly the conductivity adjusted.

In order to prevent equipment parts, electrodes and tank from becoming coated with precipitating aluminum hydroxide, a stabilizer is added. Preferably a polysaccharide such as e.g. dextran or starch, preferably at a concentration of about 0.05 wt-%.

The amount of current supplied per unit (worksurface) area determines the quality of the oxide layer on the strip or foil, the best results being obtained in the range 25–100 coulomb/dm$^2$.

The strips or foils are usefully passed through the electrolyte at such a speed that the current density lies between 3 and 100 A/dm$^2$, in particular 6–25 A/dm$^2$. The tank holding the electrolyte is dimensioned such that the oxidation time i.e. the throughput time of the strips or foils in the electrolyte in the vicinity of the electrodes amounts to 0.5–10 seconds, preferably 1–4 seconds. The type and form of current employed for oxidation is unimportant; it can be sinusoidal, square wave, triangular in form or as direct current with superimposed alternating or pulsed current. Likewise, whether the oxidation is performed with two phase or three phase alternating current, has no influence on the formation of the oxide skin.

Slightly improved results are obtained using three phase current with one phase rectified by a diode, preferably with three electrodes leading the current to the strip or foil and the middle electrode rectified. Almost the same advantage is obtained by connecting the minus potential of the other phases to the middle electrode. The slightly thicker oxide layers exhibit better corrosion resistance as a result.

The manner of conducting the current to the electrodes and the strip or foil is not important. Almost the same results are obtained if the strip, contacted directly, forms an electrode, or if the current is conducted to two or more separate electrodes, below which the strip is coupled via the electrolyte and forms a conductive connection, as described in the German patent publication No. DE-OS 33 25 802.

Compared with oxide layers formed using alternating current those formed using direct current exhibit poorer lacquer adhesion; also for adhesive bonding or laminating with plastic pretreatment with direct current is always less advantageous.

BRIEF DESCRIPTION OF THE DRAWINGS

The invention is described in greater detail in the following with the aid of the schematic drawings viz.

DETAILED DESCRIPTION

Figure 1:
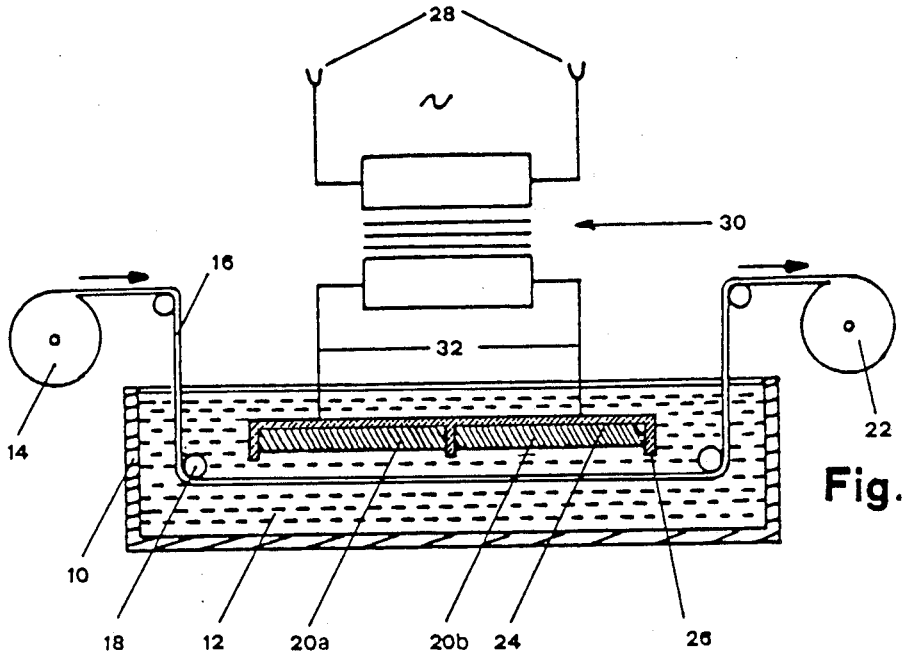
FIG. 1 is a vertical cross-section through an electrolytic cell showing the passage of a strip through the bath.

The electrolytic cell shown in FIG. 1 comprises an oxidation tank 10 containing an electrolyte 12. Aluminum strip 16 is uncoiled from roll 14, passed over deflection roll 18, conducted horizontally through the electrolyte 12 near two electrodes **20*a*, 20*b* and coiled onto another roll 22 at the other side of the cell. The electrodes 20*a*, 20*b* are mounted in a frame 24 of material which is both an electrical insulator and is resistant to attack by the electrolyte, and is embedded into the frame 24 such that only the surface of the electrodes facing the aluminum strip i.e. the electrode workface is not insulated. The vertical walls 26 of the frame 24 facing the aluminum strip 16 project out beyond the electrodes 20*a*, 20*b* and come close to the aluminum strip 16**.

The single phase transformer 30 connected to the alternating current source 28 supplies the electrodes **20*a*, 20*b*, via conductor cable 32**, with two phase sinusoidal alternating current at a frequency of 50–60 cps. A simple transformer with mains supply is the most economical solution. In laboratory trials it was found that other forms of alternating current such as e.g. square wave, triangular, or pulsed current of lower of higher frequencies do not produce a significant improvement in the quality of oxide layer obtained.

Figure 2:
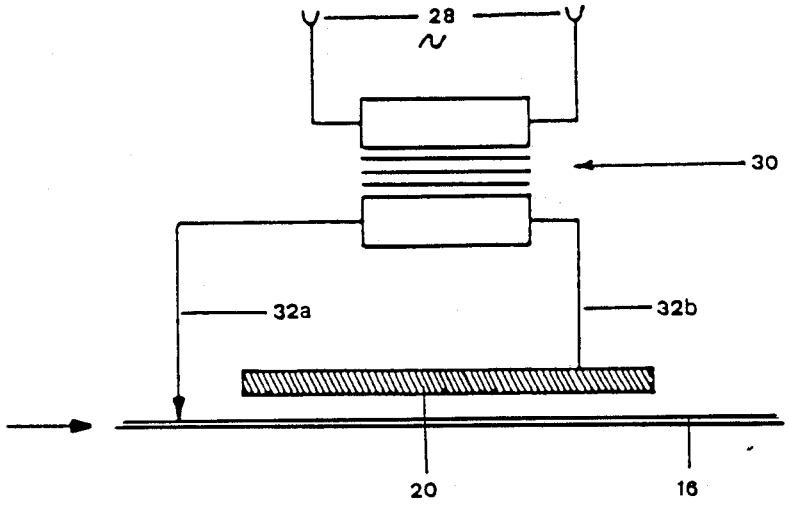
FIG. 2 is a symbolic arrangement showing the use of two phase alternating current and the strip as electrode.

The symbolic arrangement shown in FIG. 2 represents a version in which the conductor **32*a* is connected directly to the aluminum strip 16. The secondary circuit is made up of the electrolyte, which is not shown here, the single electrode 20 and conductor 32*b***.

Figure 3:
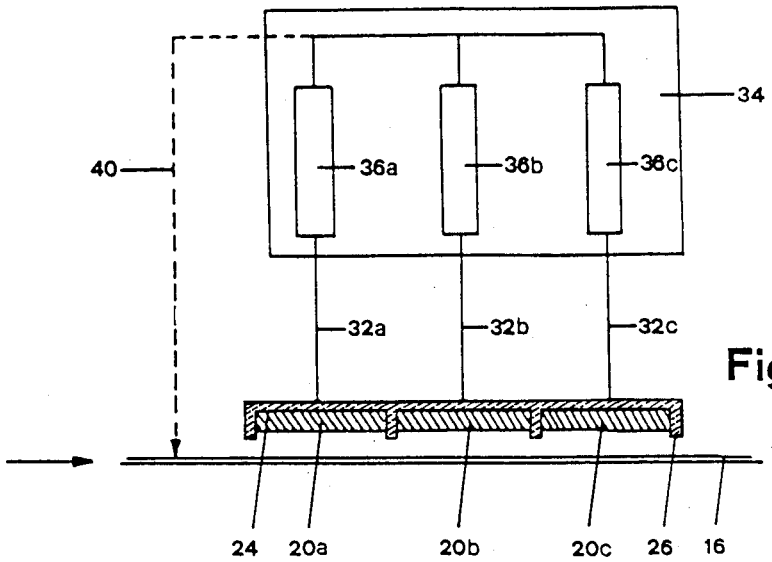
FIG. 3 is a symbolic arrangement for three phase current oxidation.

The arrangement in FIG. 3, also only represented by symbols, comprises a three-phase transformer 34 of which only the secondary windings **36*a*, 36*b* and 36*c* are shown. These secondary windings are connected to the electrodes 20*a*, 20*b* and 20*c* via conductors 32*a*, 32*b* and 32*c***.

Figure 4:
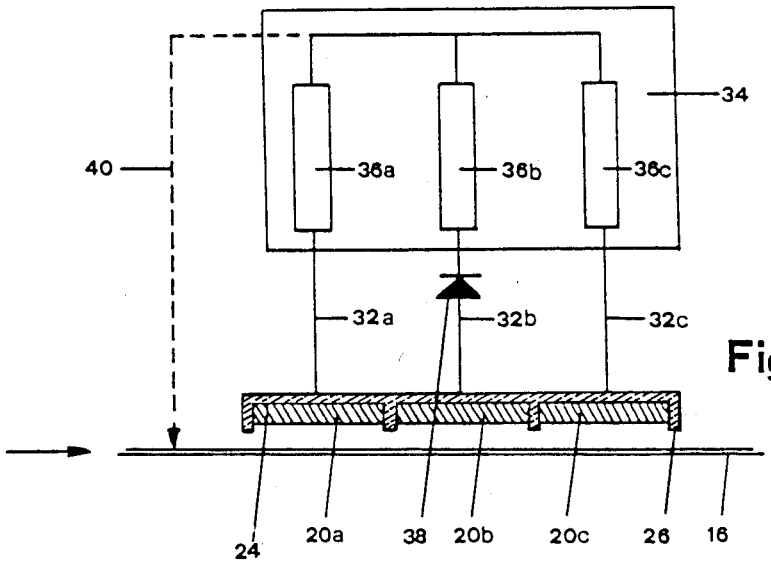
FIG. 4 is another version of that shown in FIG. 3 with one rectified phase.

The arrangement shown in FIG. 4 differs from that in FIG. 3 only in that a diode 38 has been inserted in the middle conductor **32*b*** so that this phase is rectified.

According to a version shown by broken lines in FIGS. 3 and 4 the aluminum strip 16 can be connected directly to the secondary current source via conductor 40.

What is claimed is:

1. Process for pretreating strips and foils of aluminum or aluminum alloys prior to lacquering, coating with adhesive or laminating with plastic, which comprises: providing an aluminum or aluminum alloy material in the form of strip or foil having a workface; providing a silicate-free non-toxic, non-hazardous aqueous electrolyte having a pH of 4.2 to 12.5 and consisting essentially of 0.01–10 weight percent of an organic compound that forms a complex with aluminum and contains at least one amino group with at least one carboxyl group attached to its nitrogen atom; heating said electrolyte to a temperature of from 25° to 95° C.; passing said material through said electrolyte; and supplying an alternating current of 10 to 500 coulomb/$dm^2$ to the workface while said material is passing through said electrolyte, and coating said material to provide improved adhesive qualities.

2. Process according to claim 1 wherein said carboxyl group is selected from the group consisting of —COOH, —$CH_2COOH$ and —$CH_2CH_2COOH$.

3. Process according to claim 1 wherein said organic compound that forms a complex is a complexing organic salt selected from the group consisting of salts of nitrilo-triacetic acid and salts of ethylene-diamino-tetra-acetic acid.

4. Process according to claim 3 wherein the cations in said organic salts are alkali metal ions.

5. Process according to claim 3 wherein the concentration of the complexing organic salt added to the electrolyte is 0.1–5 weight percent.

6. Process according to claim 1 wherein further additions are made to the electrolyte in order to stabilize it, its pH value and the oxidizing power of the bath, the said additions being selected from the group consisting of sodium hydroxide, potassium hydroxide, sodium carbonate and potassium carbonate.

7. Process according to claim 1 wherein the pH is adjusted to 9.5–12.

8. Process according to claim 1 wherein said current is 25–100 coulombs per $dm^2$.

9. Process according to claim 1 wherein a current density of 3–100A/$dm^2$ is employed.

10. Process according to claim 1 wherein a throughput time is employed in the region of the electrodes of 0.5–10 seconds.

11. Process according to claim 1 wherein a three phase current is employed using three electrodes.

12. Process according to claim 11 wherein a middle one of said electrodes is supplied with rectified current.

13. Process for pretreating strips and foils of aluminum or aluminum alloys prior to lacquering, coating with adhesive or laminating with plastic, which comprises: providing an aluminum or aluminum alloy material in the form of strip or foil having a workface; providing a silicate-free non-toxic, non-hazardous aqueous electrolyte having a pH of 4.2 to 12.5 and comprising 0.01–10 weight percent of an organic compound that forms a complex with aluminum and contains at least one amino group with at least one carboxyl group attached to its nitrogen atom; heating said electrolyte to a temperature of from 25° to 95° C.; passing said material through said electrolyte; and supplying an alternating current of 10 to 500 coulomb/$dm^2$ to the workface while said material is passing through said electrolyte, and coating said material to provide improved adhesive qualities, wherein said organic compound that forms a complex is a complexing organic salt selected from the group consisting of nitrilo-triacetic acid and ethylene-diamino-tetra-acetic acid and wherein the cations in said organic salts are ammonium ions.

14. Process for pretreating strips and foils of aluminum or aluminum alloys prior to lacquering, coating with adhesive or laminating with plastic, which comprises: providing an aluminum or aluminum alloy material in the form of strip or foil having a workface; providing a silicate-free aqueous electrolyte having a pH of 4.2 to 12.5 and comprising 0.-1–10 weight percent of an organic compound that forms a complex with aluminum and contains at least one amino group with at least one carboxyl group attached to its nitrogen atom; heating said electrolyte to a temperature of from 25° to 95° C.; passing said material through said electrolyte; and supplying an alternating current of 10 to 500 coulomb/$dm^2$ to the workface while said material is passing through said electrolyte, and coating said material to provide improved adhesive qualities, wherein a polysaccharide is added to the electrolyte in an amount effective to stabilize the electrolyte selected from the group consisting of dextran and starch.

15. Process for pretreating strips and foils of aluminum or aluminum alloys prior to lacquering, coating with adhesive or laminating with plastic, which comprises: providing an aluminum or aluminum alloy material in the form of strip or foil having a workface; providing a silicate-free aqueous electrolyte having a pH of 4.2 to 12.5 and comprising 0.01–10 weight percent of an organic compound that forms a complex with aluminum and contains at least one amino group with at least one carboxyl group attached to its nitrogen atom; heating said electrolyte to a temperature of from 60° to 70° C.; passing said material through said electrolyte; and supplying an alternating current of 10 to 500 coulomb/$dm^2$ to the workface while said material is passing through said electrolyte, and coating said material to provide improved adhesive qualities.

* * * * *